US007240862B2

(12) United States Patent
Grasselli et al.

(10) Patent No.: US 7,240,862 B2
(45) Date of Patent: Jul. 10, 2007

(54) METHOD AND APPARATUS FOR DISRUPTING CELLS IN A FLUID SUSPENSION BY MEANS OF A CONTINUOUS PROCESS

(75) Inventors: Silvia Grasselli, Parma (IT); Marco Gandini, Parma (IT); Simone Grandi, Sala Baganza (IT)

(73) Assignee: Niro-Soavi S.p.A., Parma (IT)

( * ) Notice: Subject to any disclaimer, the term of this patent is extended or adjusted under 35 U.S.C. 154(b) by 278 days.

(21) Appl. No.: 10/937,338

(22) Filed: Sep. 10, 2004

(65) Prior Publication Data

US 2005/0197409 A1 Sep. 8, 2005

(30) Foreign Application Priority Data

Feb. 24, 2004 (IT) ..... PR2004A0015

(51) Int. Cl.
*B01F 5/06* (2006.01)

(52) U.S. Cl. ..... 241/2; 241/38; 417/454

(58) Field of Classification Search ..... 241/2
See application file for complete search history.

(56) References Cited

U.S. PATENT DOCUMENTS 5,411,380 A * 5/1995 Bristol et al. ..... 417/454
5,972,642 A * 10/1999 Flenø et al. ..... 435/67
6,110,469 A * 8/2000 Singh et al. ..... 424/248.1
6,951,746 B2 * 10/2005 Tanimoto et al. ..... 435/128
6,987,173 B2 * 1/2006 Lee et al. ..... 530/399

* cited by examiner

*Primary Examiner*—Derris H. Banks
*Assistant Examiner*—Jason Y. Pahng
(74) *Attorney, Agent, or Firm*—Pearne & Gordon LLP

(57) ABSTRACT

Method for disrupting *S. Cerevisiae* yeast cells in an aqueous solution, by means of a continuous process under high pressure (up to 4000 bar), using a homogenizer.

The suspension to be processed passes through a homogenizing valve with a "sharp edge" or "knife edge" passage head in order to achieve a 100% cell disruption rate with a single passage, at a dynamic pressure equal to or above 2000 bar.

The "sharp edge" or "knife edge" profile of the passage head (4) is characterized by an inside diameter (9) of 10.9-14 mm and an outside diameter (10) of 11.9 mm-15 mm, and operates at a flow rate of 100-500 liters/hour and a dynamic pressure of more than 2000 bar.

4 Claims, 4 Drawing Sheets

METHOD AND APPARATUS FOR DISRUPTING CELLS IN A FLUID SUSPENSION BY MEANS OF A CONTINUOUS PROCESS

BACKGROUND OF THE INVENTION

This invention relates to a method and an apparatus for disrupting cells in a fluid suspension by means of a continuous process.

The disruption of cells is an important step in many biotechnological processes. Although some biological products are secreted by the cells or released by autolysis, many others, including vaccines, therapeutic substances, enzymatic and diagnostic preparations, must be obtained by disintegrating the cells in order to isolate the product molecules or other subcellular components, such as the membrane.

In the laboratory, cells are usually disintegrated by means of mechanical, physical (ultrasound), chemical and biological processes.

At industrial level, on the other hand, high-pressure technology or bead mills are generally used. In some special cases enzymatic and chemical processes may be used.

All areas of biotechnology, especially those that make use of recombinant and pathogenic microorganisms or their cellular components, can benefit from the use of controlled cell disruption processes that do not involve any biological hazards (containment) and can be certified. Biotechnological processes must be designed and implemented to comply with the applicable process containment and decontamination safety standards. If possible, all equipment in any way associated with the process should be certified.

Very often the aim of a cell disruption process is to achieve productive and limited disruption, but the choice of equipment for the downstream process is dictated by the need to comply with specific containment and hazard prevention requirements when processing certain categories of cells such as genetically modified microorganisms (OGMs) and pathogens. Up until now the use of protein-secreting microorganisms and the subsequent separation of the product by filtering or centrifugation have influenced the use of cell disrupting equipment, considered inadequate in terms of containment, although there have been some recent developments in this area.

Cell disruption is usually assessed subjectively and empirically by inspecting the cell broth (colour, optical density, product viscosity). However, in order to perform an objective assessment the product must be analysed by measuring the size of the particles before and after the process and observing their physical integrity, or by measuring the extracellular activity of an indicator enzyme. Microscopy, preferably using a phase contrast optical microscope that is also capable of recognizing any partially disrupted cells, is a fast and reliable method for assessing the level of cell disruption. This is extremely important for the downstream process, as the product can be released even in the event of partial disruption, while the remaining particle is big enough to facilitate the centrifugal separation process. The most suitable method for use in a production process still consists of analyzing the product directly or measuring its activity.

The ideal cell disruptor should satisfy all of the following criteria: be capable of disrupting even the hardest microorganisms without destroying the intracellular material; be controllable and reproducible; have CIP and SIP capabilities; be compatible with the implementation of biohazard control procedures (containment); ensure compliance with the applicable pharmaceutical standards; be capable of ensuring disruption with a single passage in a continuous process in order to prevent denaturation and reduce processing times and costs; have controlled heat generation (to prevent denaturation); be automation-compatible; be capable of processing volumes that are consistent with the plant's fermentation/separation capacity; be capable of continuous operation; have low operating costs (low energy consumption, require only occasional maintenance, spare parts must be cheap and readily available); require a limited initial outlay; be compact.

As regards controlled heat generation, in an ideal cell disruptor overheating should be avoided by means of adequate cooling before and after disruption, using a heat exchanger.

There are various methods for performing cell disruption.

A first method consists of disruption by means of thermal shock, or hot/cold treatment. This widely used method is also the most traditional; it is also simple and not particularly expensive. Since this method is absolutely non-selective, a possible secondary effect could be the denaturation of the intracellular substances.

A second method consists of disrupting the microbial cells biologically. Much research has been carried out into the action of enzymes and chemical substances and we have adequate information as regards the formation or dissociation of specific bonds and the concurrent loss of integrity of the structural macromolecules in the cell wall or membrane, resulting in the lysis of the bonds that form the membrane or cell wall. This method is highly selective and precise but preparation is complex and costly and it is not suitable for scale-up.

A third method consists of disruption using chemical substances. Detergents, solvents and acids are usually added to the cell broths to induce the death of the cells and subsequent disruption. This method is sufficiently specific and not particularly expensive, but has repercussions on the end product: the substances that are added contaminate the end product and must be removed and eliminated.

A fourth method is based on the use of ultrasound technology, or sonication. This method is only suitable for laboratory use and generates a great deal of heat that is transferred to the processed product.

A fifth method, which is not as well known and is less commonly used, consists of mechanical cell disruption.

Some mechanical systems, such as bead mills, use shearing forces to break the cells. This is a reliable and reproducible method; however continuous operation is not possible, processing is slow and the equipment is not easy to clean.

A sixth method concerns the use of high-pressure mechanical systems. Cell disruption is induced by the sudden passage from a high-pressure zone to a low-pressure zone, with or without impaction, which causes the cells to break.

There are two types of high-pressure mechanical systems: those that use isostatic pressure and those that use dynamic pressure. Isostatic pressure is used in isostatic presses. These machines are extremely efficient but very expensive in terms of the initial outlay and also as far as energy consumption is concerned. The process is discontinuous and is not easily adapted to suit different production requirements, given the small volumes involved.

High-pressure homogenizers use dynamic pressure. These systems are highly reproducible and also available on a large scale. They are extremely easy to use and are suitable for CIP and SIP cleaning procedures.

The dynamic high-pressure system best satisfies the criteria listed above for the ideal cell disruption method, especially for liquid products.

In the prior art the maximum pressure that can be applied is 1500 bar, both on a laboratory and industrial scale. This enables good results to be achieved but requires several passages through the machine (recirculation).

U.S. Pat. No. 4,773,833 describes a homogenizer comprising a homogenizing valve mounted on a pump assembly. The pump has a single pump head, but comprises an intake duct with a hemispherical end part and a delivery duct with a hemispherical end part that lead into a hemispherical chamber in the pump, thus eliminating all the sharp corners and giving the inside of the head a specific shape to improve fatigue strength. However, this type of configuration does not easily withstand pressures of above 1000 bar.

Patent PR99A000045 by the author of this patent application relates to a high-pressure fluid pump comprising a floating plunger in a pumping chamber in which the fluid is pumped from a fluid intake zone to a fluid delivery zone; a block for each piston, to connect the pumping chamber to the intake and delivery valves housed in containers to the side that are fastened to the block. Each block comprises two semi-parts or plates that are clamped together and have grooves on the inside that house an internal manifold connecting the pumping chamber with the intake and delivery valves.

SUMMARY OF THE INVENTION

The purpose of this invention is to eliminate the drawbacks described above with a method and an apparatus capable of operating at much higher maximum pressure levels in order to achieve a 100% cell disruption rate with a single passage.

Said purpose is fully achieved by the method and apparatus according to this invention, as described more fully in the claims below and characterized in that the method consists of processing the suspension in a homogenizing valve with a "sharp edge" passage head at pressures equal to or above 2000 bar, in order to achieve a 100% cell disruption rate with a single passage.

The homogenizer is equipped with at least one homogenizing valve assembly comprising:

a high-pressure chamber that is in communication with a channel supplying the high-pressure fluid to be homogenized;

a low-pressure chamber that is in communication with a channel discharging the low-pressure homogenized fluid, an orifice that connects the high-pressure chamber and the low-pressure chamber, defined by an impact head that is axially mobile in correspondence with an impact ring in relation to a fixed passage head, in which the passage head has a "sharp edge" or "knife edge" profile with an inside diameter of 10.9-14 mm and an outside diameter of 11.9 mm-15 mm, and operates at a flow rate of 100-500 liters/hour at a pressure of more than 2000 bar.

BRIEF DESCRIPTION OF THE DRAWINGS

This and the other characteristics of this invention will become clear from the following detailed description of a preferred embodiment and the drawings that are attached hereto, which are merely illustrative and not limitative, in which.

DESCRIPTION OF THE PREFERRED EMBODIMENTS

Figure 1:
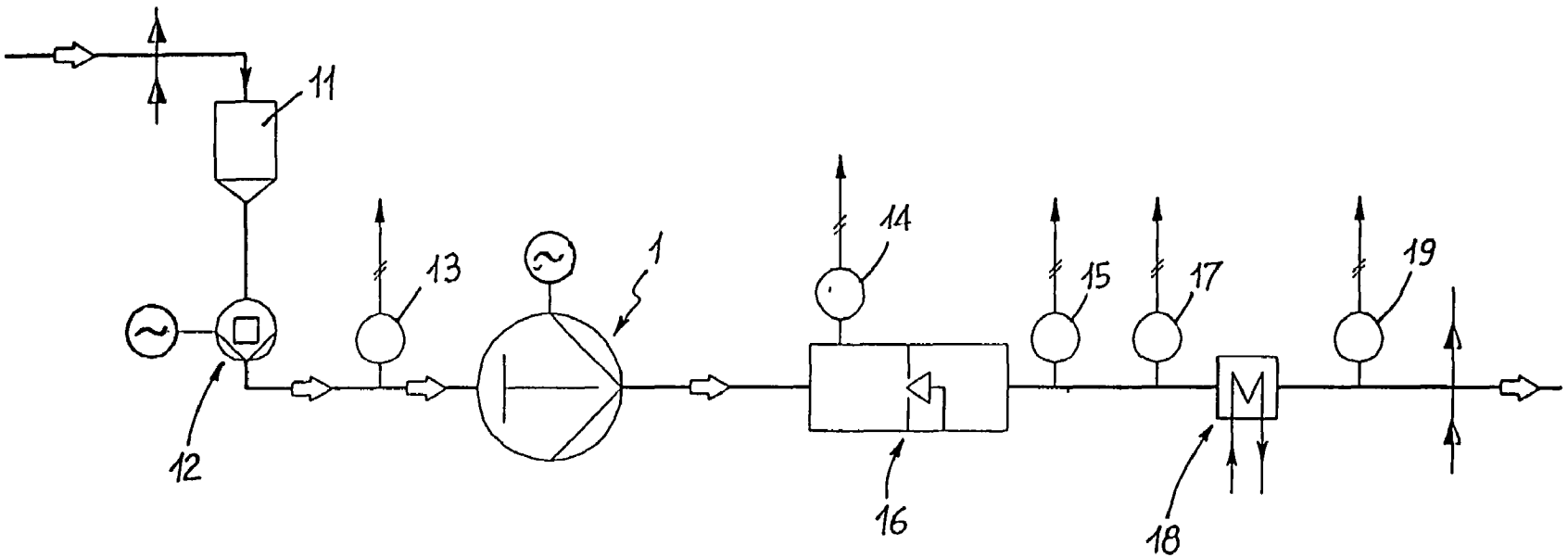
FIG. 1 is a block diagram of the invention.
Figure 2:
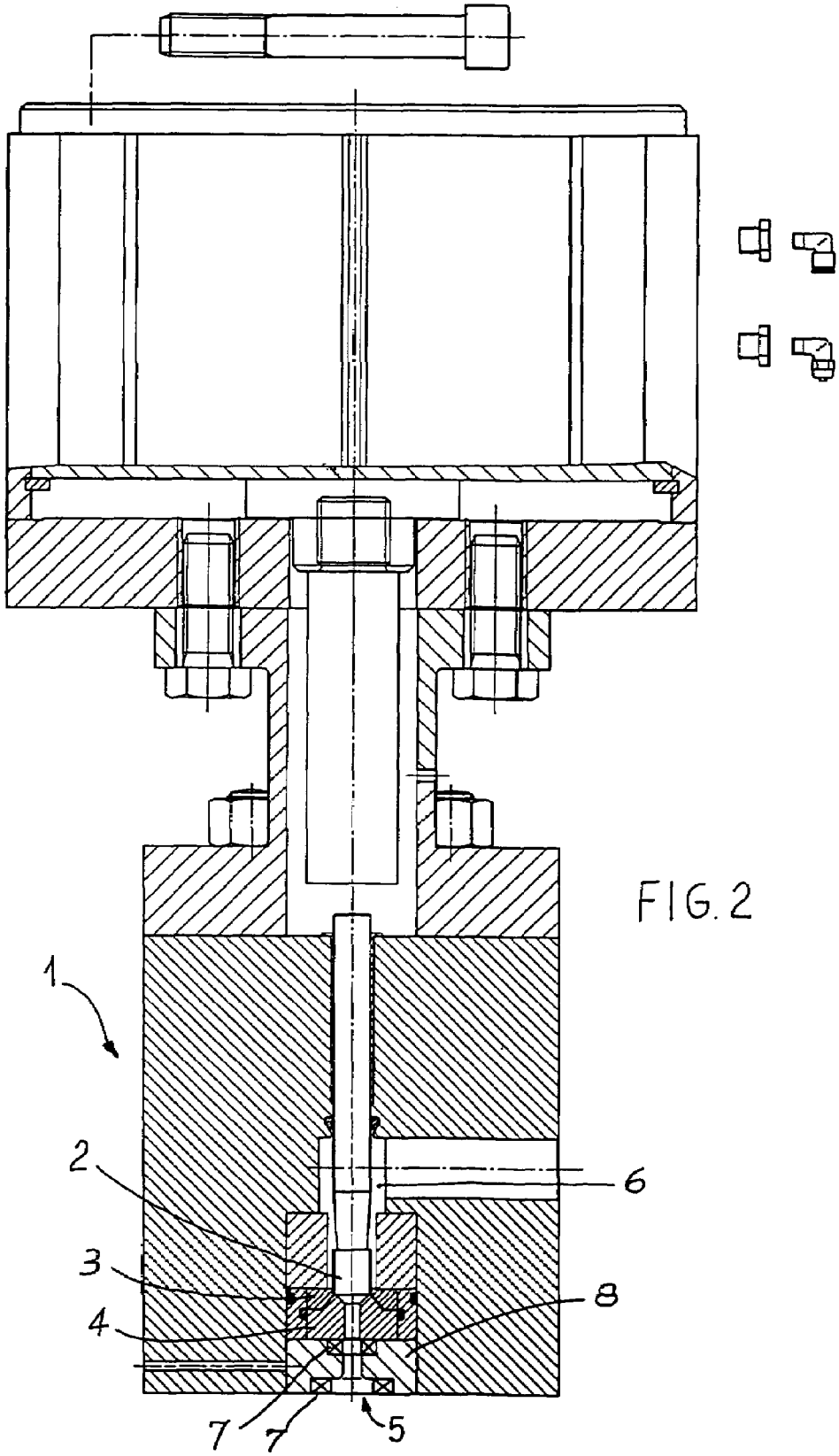
FIG. 2 is a cross-section of the apparatus.
Figure 3:
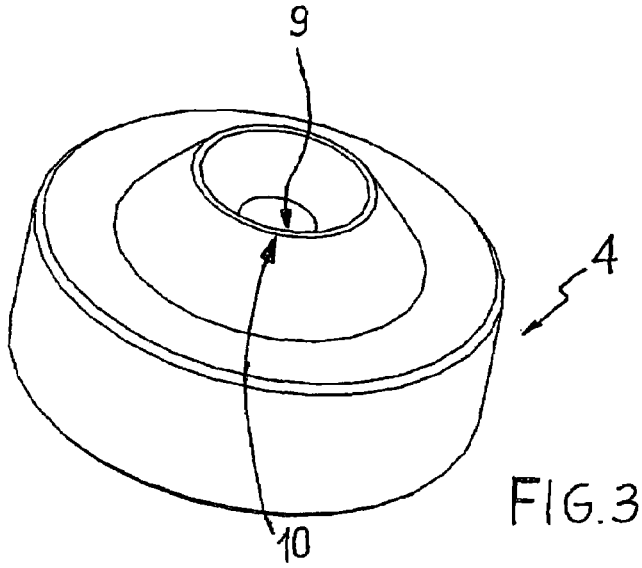
FIGS. 3 and 4 illustrate the passage head of the apparatus, respectively in a perspective view and a vertical cross-section at mid length.

With reference to the figures, number 1 indicates the homogenizer as a whole, in which the homogenizing valve comprises an impact head 2 that is axially mobile in correspondence with an impact ring 3 in relation to a fixed passage head 4. Homogenization and the passage between a high-pressure chamber 5 and a low-pressure chamber 6 take place between the two heads.

Numbers 7 and 8 indicate gaskets and a gasket spacer ring respectively.

The passage head 4 has an original "sharp edge" or "knife edge" profile that enables the required level of micronization, dispersion and disruption to be achieved as the fluid passes at a very high speed from the high-pressure zone (on the inside edge of the valve) to the low-pressure zone (on the outside edge of the valve).

In particular, the inside diameter 9 or effective diameter of the valve measures between 10.9 and 14 mm, while the outside diameter 10 measures between 11.9 and 15 mm, with a flow rate of between 100 and 500 l/h and an operating pressure of between 1000 and 4000 bar, and preferably of between 2000 and 4000 bar.

Figure 4:
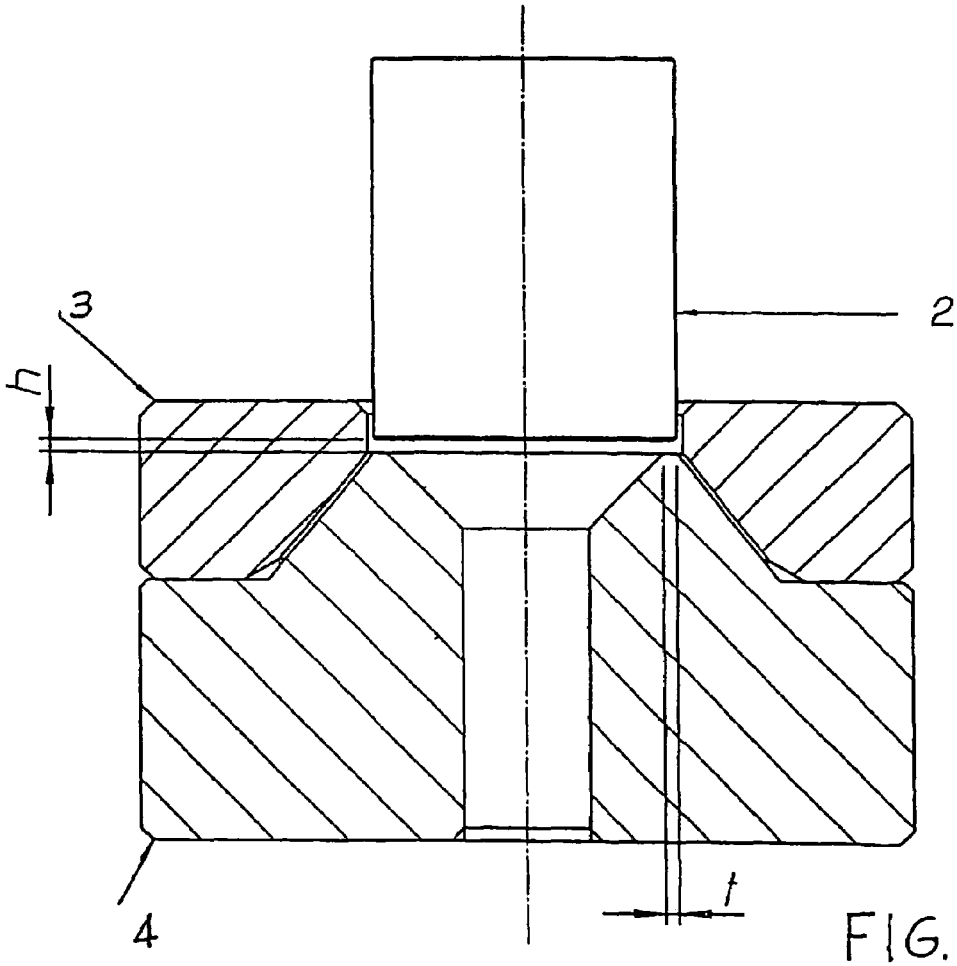

The radial travel distance t (illustrated in FIG. 4), defined as the difference between the outside radius and the inside radius, is between 0.3 and 1 mm, and preferably 0.5 mm.

If the radial travel distance is increased from 0.5 to 1.95 mm there is a loss of efficiency which means that between 50% and 100% more pressure is required in order to obtain the same result.

Laboratory tests on *Saccaromices Cerevisiae* have demonstrated that valves with a sharp edge or knife edge profile and a small radial travel distance in relation to the size of the valve and the relative flow rate, allow a better cell disruption rate to be achieved with a single passage.

Figure 5:
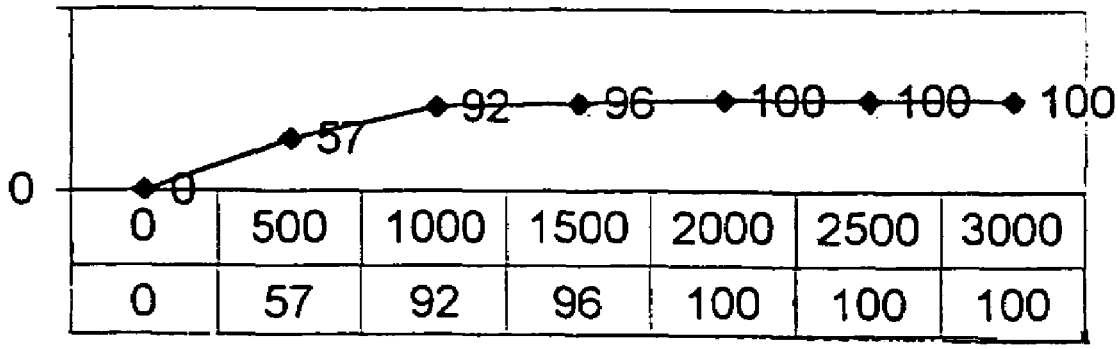
FIG. 5 is a graph showing the cell disruption rates at different pressures.

With specific reference to the graph in FIG. 5, which refers to an inside diameter of 10.9 mm and an outside diameter of 11.9 mm, with a pressure of 500 bar a 57% cell disruption rate is achieved. This rises to 92% at 1000 bar, 96% at 1500 bar and 100% from 2000 bar, with a single passage.

The first line of data beneath the graph contains the pressure values, while the second line indicates the cell disruption rates obtained with a single passage.

The geometry of the valve is thus characterized by a very small upper surface between the inside and outside diameters.

The rate at which the fluid flows through the valve and the pressure that is applied define, in relation to the dimensions of the actual valve, the so-called operating height h (illustrated in FIG. 4) of the valve, which is another important parameter in terms of the dimensioning of the homogenizing valve in relation to cell disruption efficiency.

The theoretical operating height h of the valve, also called the "gap", is the axial distance between the axially mobile impact head and the fixed passage head.

In the specific case the operating height is originally between 3 and 5 μm.

The speeds on the inside diameter range from 500 to 800 m/s; the corresponding speeds on the output edges of the outside diameter range from 400 to 600 m/s.

The outside diameter being equal, the smaller the inside diameter the higher the speed of the incoming flow.

The original method according to this invention consists of processing a fluid suspension in a homogenizing valve with a passage head that has a "sharp edge" or "knife edge" profile at a pressure of more than 2000 bar and preferably less than 4000 bar, in order to achieve a 100% cell disruption rate with a single passage.

In the specific case the fluid suspension is a suspension of *S. Cerevisiae* yeast cells, in a 10% aqueous suspension.

Having carried out numerous tests to assess the effects of the increase in pressure, the geometry of the homogenizing valve and the temperature on yeast cell disruption (the level of disruption was measured by means of a cell count under an optical microscope before and after using the homogenizer), it was surprising to discover that at a pressure of 2000 bar applied to the product by means of a high-pressure homogenizer it is possible to achieve a 100% cell disruption rate with a 10% aqueous suspension of *S. Cerevisiae* yeast cells at temperatures of 8-9° C. at the homogenizer intake side.

A tubular heat exchanger is installed on the homogenizer outlet side to lower the temperature of the product immediately as soon as said product has passed through the homogenizer.

The increased homogenization pressure increases the level of cell disruption and also the temperature of the product coming out of the homogenizer, but if the geometry of the valve is not suitable, even a pressure of 4000 bar is not sufficient to achieve a 100% cell disruption rate with a single passage.

The temperature does not affect the level of cell disruption and the rise in temperature does not produce cell disruption in the absence of a suitable valve geometry.

Under specific combinations of working pressure and valve geometry, the method and apparatus according to this invention enable a 100% cell disruption rate to be achieved with a single passage, whereas the methods known in the prior art only achieve a maximum cell disruption rate of 94%, which is too low in view of the fact that *S. Cerevisiae* cells reproduce themselves for example every 20 minutes.

With reference to FIG. 1, the "flow sheet" of the plant illustrates in sequence a tank 11 that collects the fluid suspension to be processed; a delivery pump 12 that supplies the homogenizer in an appropriate manner; a pressure gauge 13 on the line leading to the homogenizer; the homogenizer 1 incorporating a homogenizing valve assembly 16; a pressure gauge 14 before and another pressure gauge 15 after the homogenizing valve assembly 16; a temperature sensor 17; a tubular heat exchanger 18 to lower the temperature of the fluid suspension immediately; a flow meter 19.

What is claimed:

1. Method for disrupting cells in a fluid suspension, comprising processing the suspension in a homogenizing valve with a sharp edge or knife edge passage head with an inside diameter of 10.9-14 mm and an outside diameter of 11.9-15 mm and a difference between said diameters of 0.15-0.5 mm, the processing being at a pressure equal to or above 2000 bar, in order to achieve a 100% cell disruption rate with a single passage, the suspension passing at a flow rate of 100-500 liters/hour and a speed higher than 400 m/s from a high-pressure zone on the inside edge of the valve to a low-pressure zone on the outside edge of the valve.

2. Method according to claim 1, in which the fluid suspension is a suspension of *S. Cerevisiae* yeast cells.

3. Method according to claim 2, in which the suspension is a 10% aqueous suspension.

4. Method according to claim 1, in which the pressure is between 2000 and 4000 bar.

* * * * *